United States Patent [19]

Bustos et al.

[11] 4,148,533

[45] Apr. 10, 1979

[54] DISPLAY RACK FOR PACKAGED AND DISPENSABLE BEVERAGES

[75] Inventors: Rafael T. Bustos, Clarkston; William B. Taylor, Chamblee; Charles L. Davis; Lawrence G. Kern, both of Atlanta, all of Ga.

[73] Assignee: The Coca-Cola Company, Atlanta, Ga.

[21] Appl. No.: 769,363

[22] Filed: Feb. 16, 1977

[51] Int. Cl.[2] ..... A47B 77/00

[52] U.S. Cl. ..... 312/223; 312/128; 312/198; 108/23; 211/49 S

[58] Field of Search ..... 312/223, 128, 196, 198, 312/195, 224; 108/23; 211/182, 49 S

[56] References Cited

U.S. PATENT DOCUMENTS

| | | | |
|---|---|---|---|
| 2,517,963 | 8/1950 | Bausch | 312/224 |
| 2,574,164 | 11/1951 | Baay | 312/223 |
| 2,642,329 | 6/1953 | Fitzgerald et al. | 312/223 |
| 2,939,946 | 6/1960 | Holderle et al. | 211/182 |
| 3,041,957 | 7/1962 | Liptay | 312/223 |
| 3,151,744 | 10/1964 | Patterson | 211/49 S |
| 3,677,203 | 7/1972 | Barrineau | 211/49 S |
| 3,920,299 | 11/1975 | Propst et al. | 312/223 |
| 3,980,361 | 9/1976 | Shaw et al. | 312/223 |

*Primary Examiner*—Victor N. Sakran

[57] ABSTRACT

A display rack for displaying in a market the combination of packaged soft drinks, advertising signs associated therewith, and chilled soft drinks for local consumption in the market is described. The display rack includes a central station in which a lithographed artwork depicting the products being sold or dispensed is disposed. A chilled beverage dispenser fits into the central section below the lithographed artwork. On each side of the central section is a shelf unit for storing and displaying packaged beverages of a like or similar kind to those dispensed in the central section of the display rack, as well as to those found in the packaged goods section at a separate location of the supermarket. A roof or canopy fits over all three sections of the display rack and holds them together as one unit. The canopy has an open top and diffuser panels in the bottom thereof to faciliate the illumination of the display rack sections with ambient light. A plurality of decorative lanterns are secured to the canopy. These lanterns include reflectors therein which reflect ambient light to give the appearance of being electrically energized.

17 Claims, 4 Drawing Figures

DISPLAY RACK FOR PACKAGED AND DISPENSABLE BEVERAGES

BACKGROUND OF THE INVENTION

1. Field of Invention

The present invention relates to a display rack for storing and marketing soft drinks in a supermarket or the like. More specifically, the present invention relates to a display rack for marketing both dispensed chilled soft drinks for local consumption and packaged soft drinks to be purchased for later consumption at a remote location.

2. Description of the Prior Art

Heretofore, packaged soft drinks and dispensable chilled soft drinks offered for sale in a supermarket have been displayed and stored in separate units and at separate locations in a supermarket. Accordingly, a customer would consume a chilled beverage at one location in the supermarket and after having enjoyed his favorite beverage would get the urge to purchase packaged beverages of a like kind for consumption at home. With the traditional separate locations of the dispenser for the chilled beverage and the packaged goods, this necessitated a search by the customer for the location of the packaged goods causing an inconvenience to the customer. This inconvenience could of course result in the loss of a sale of the packaged beverage.

Although some merchants have undoubtedly recognized the above problem and arranged their separate display racks in more convenient locations, a need in the art exists for a unitary display rack structure which displays and supports dispensable chilled soft drinks, packaged soft drinks, and advertising material associated therewith at a single location to aid all merchants in maximizing their sales of soft drinks.

SUMMARY OF THE INVENTION

Accordingly, it is a primary object of the present invention to provide a unitary display and support structure for marketing dispensable chilled soft drinks and packaged soft drinks at a common location in a supermarket.

It is another object of the present invention to provide a sectional display rack which may be preassembled and coupled together by a decorative canopy.

It is a further object of the present invention to provide a display rack which utilizes the ambient light of the supermarket to illuminate the contents of the display rack.

It is still a further object of the present invention to provide a display rack including means for attractively displaying advertising artwork associated with the goods to be sold.

These and other objects of the present invention are fulfilled by providing a unitary display rack structure for supporting and displaying dispensable chilled soft drinks, packaged soft drinks, and advertising artwork associated therewith including a central section in which there is disposed an advertising artwork of the soft drink being marketed disposed above a chilled drink dispenser mounted on the floor of the supermarket, a pair of support shelf structures disposed on opposite sides of the central section, a roof or canopy which fits over top of both the central section and the two side sections consisting of the shelf units, diffuser panels disposed in the bottom of the canopy for facilitating illumination of the merchandise supported within the display rack by overhead ambient light from the light fixtures in the supermarket and a plurality of decorative lanterns extending from the canopy at spaced positions, said decorative lanterns including reflector means therein for catching ambient light and reflecting the same therethrough to give the illusion of being electrically energized.

There is provided in addition a spot light recessed in the bottom of the canopy in the region of the central section of the display rack for directing light onto a lithographic artwork advertisement of the beverages being sold. Also provided on the canopy above the central section is a holder for a card containing indicia explaining to the customer the function of the display rack or any other suitable logo or messages which the merchant desires to display.

BRIEF DESCRIPTION OF THE DRAWINGS

The objects of the present invention and the attended advantages thereof will become more readily apparent by reference to the following drawings wherein.

DESCRIPTION OF THE PREFERRED EMBODIMENT

Figures 1, 4:
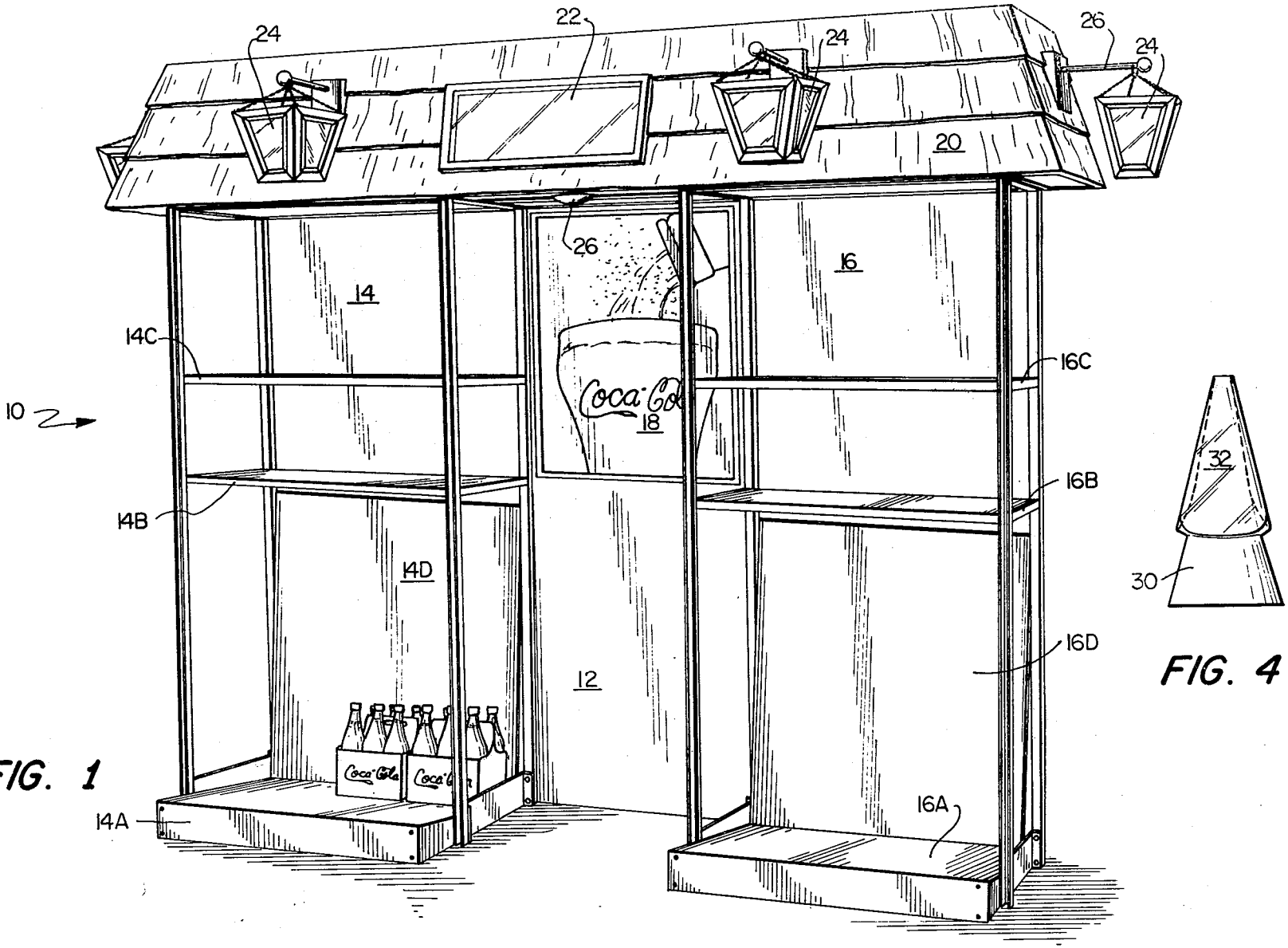
FIG. 1 is a perspective view illustrating the display rack of the present invention.
FIG. 4 is a side elevational view of a reflector means disposed within the decorative lantern of the display rack of FIG. 1.

Referring in detail to FIG. 1, there is illustrated in perspective the display rack of the present invention generally indicated 10. As illustrated, there is provided a pair of shelf units 14, 16 disposed on opposite sides of a central section 12 for supporting and displaying packaged goods to be purchased for consumption at a remote point. Each of the shelf units 14, 16 contain a plurality of horizontally supported shelves secured in vertically upstanding frame members as is conventional in most adjustable shelving units. The bottom portions or shelves 14A and 16A of each shelf unit 14 and 16, respectively, are provided with a sloped bottom portion which slopes toward the rear of the shelf unit defined by rear panels 14D and 16D. As illustrated in shelf unit 14, this bottom portion of each shelf unit may be utilized to support a plurality of cartons of soft drinks. The bottom shelves 14A, 16A are attached to the backing member 14D and 16D, and as can be seen in the illustration of FIG. 1 are sloped toward the rear of the shelf units in order to tilt the cartons of soft drinks toward the rear to preclude them from falling outwardly of the racks onto a customer. The upper shelves 14B, 14C, 16B and 16C of the respective shelf units are adapted for supporting packaged soft drinks which might be contained in larger bottles such as a 16 ounce or 32 ounce size.

A suitable backing member comprised of a plurality of panel members extends across the rear of both shelf units and the central section 12 and helps hold the entire unit together. The backing unit may be any suitable type of decorative panel which adds to the ornamental and aesthetic nature of the display unit. Mounted on this backing member in the central section 12 is a lithographic print or artwork of the beverage being marketed, in this instance a picture of a glass of Coca-Cola being filled from a bottle such as those available for sale on the shelf unit 14, 16. This artwork is illuminated from above by a spotlight 26 mounted in the soffit portion of a canopy 20 to be described further hereinafter with reference to FIG. 3.

A canopy or roof portion 20 is provided and fits over the entire display rack including shelf units 14, 16 and central section 12 and has the appearance of a shake roof of the mansard type. The surface of the canopy may be fabricated from individual cedar shake shingles or, as in a preferred embodiment, may be molded as one unitary piece from plastic.

Disposed at spaced locations about the periphery of the canopy 20 are a plurality of decorative lanterns 24 which hang by chains or other suitable means from decorative poles 26 attached to canopy 20.

In addition, there is provided on the face of canopy 20 just above the central section 12 a holder 22 for a display card containing any suitable message or logo desired by the merchant operating the supermarket.

A suitable dispenser for chilled beverages to be consumed by a customer within the supermarket is located beneath the advertising artwork 18 in the central section 12 of the display rack between the side shelf units 14 and 16. Any suitable type of chilled beverage dispenser may be utilized without departing from the spirit and scope of the present invention. For example, a chilled beverage dispenser unit may be of the post mix type or of any suitable type which dispenses chilled bottles or cans of soft drinks. The size of the central section 12 shall be chosen to receive dispenser mechanisms of conventional sizes.

The entire display rack of FIG. 1 with the exception of the light provided by spotlight 26 utilizes the ambient overhead light available in conventional supermarkets to illuminate the goods being displayed for sale. The structural features of the display rack of FIG. 1 which make this possible will be described in more detail hereinafter with respect to FIGS. 3 and 4. However, briefly, the ambient light from above passes through an open top of the canopy 20 and through diffuser panels disposed in the bottom thereof so that diffused light is distributed across the packaged goods being displayed on the shelf units and the dispenser mechanism in the central section. In addition, the top portions of the decorative lanterns are open and ambient light from above passes therethrough and is reflected off of reflector means therein to give the illusion of lanterns which are electrically energized. As illustrated in FIG. 1, the lanterns 24 are truncated structures having transparent side panels, such as glass or plastic, through which light reflected from the interior thereof passes. The glass panels may be of any suitable color to provide a decorative appearance thereto. Since the majority of the light utilized for illuminating the display in the present invention is ambient light, maintenance is substantially reduced as a great savings of power costs to the merchant are facilitated.

Figure 2:
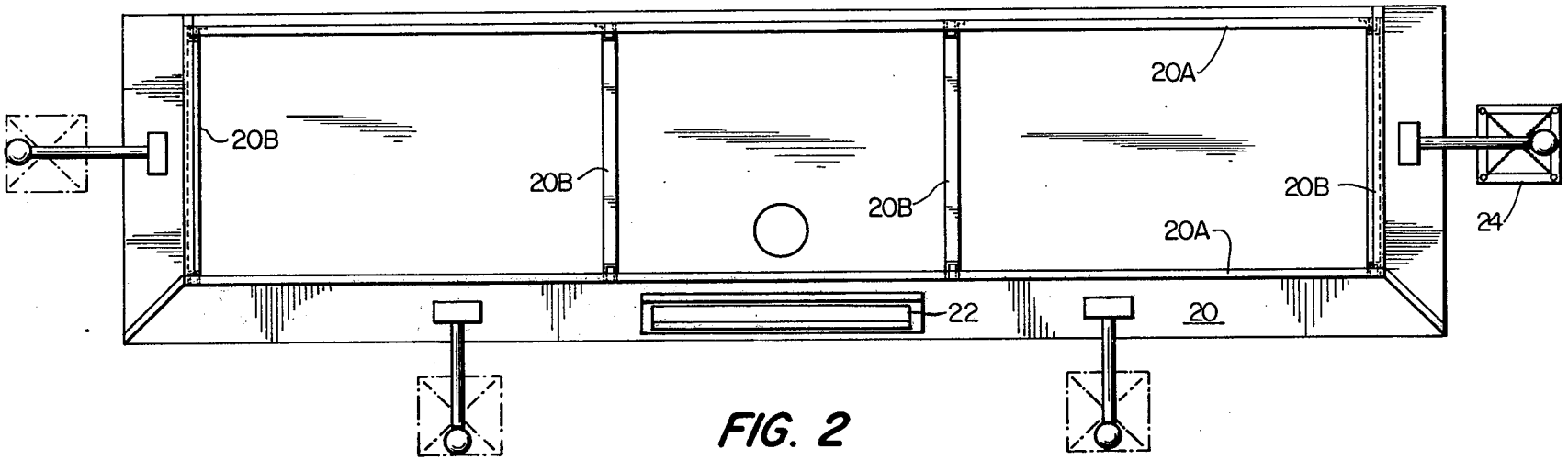
FIG. 2 is a top plan view of the canopy of the display rack of FIG. 1.

Referring in more detail to the canopy or roof structure 20 of FIG. 1, there is illustrated in FIG. 2 a top plan view thereof. As illustrated in FIG. 2, the canopy 20 is supported around a rectangular frame structure consisting of side frame members 20A and transverse frame members 20B which may be steel channels or any other suitable material secured together in the manner shown. The frame structure defines an open top to canopy 20 through which ambient light from the overhead lighting fixtures in the supermarket may enter.

Figure 3:
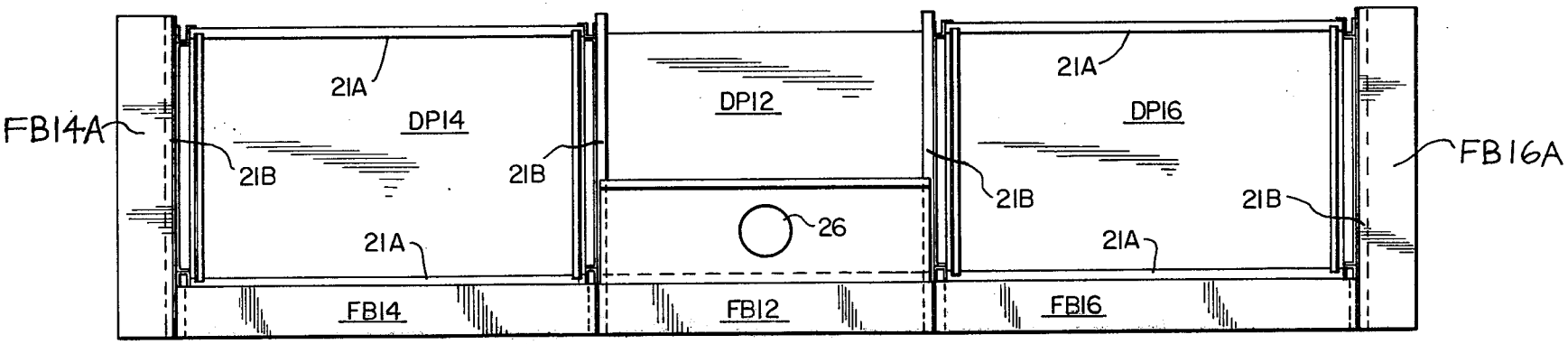
FIG. 3 is a bottom plan view of the canopy of FIG. 2 illustrating the details of the soffit which runs across the bottom thereof.

FIG. 3 is a bottom plan view of the canopy 20 of FIGS. 1 and 2 and illustrates in detail the soffit structure thereof. As illustrated, the bottom of canopy 20 is also provided with a frame structure consisting of side rail portions 21A and transverse cross pieces 21B. The outermost transverse end pieces 21B can be adapted for sliding movement in order to accomodate side shelf units 14, 16 of varying widths. For example, these end elements 21B are slidable in within the front and rear canopy frame structure and the side shelf units 14, 16 may be 24 or 36 inch wide units as desired. The undersurface of the canopy 20 in the soffit illustrated in FIG. 3 includes a plurality of clear diffuser panels DP 14, DP 12 and DP 16 disposed above the shelf units 14 central section 12 and shelf unit 16, respectively. These diffuser panels evenly distribute the ambient light from overhead fixtures onto the display rack sections therebelow. Accordingly, no additional electric power for illuminating the goods being marketed is required. The sections of the soffit of FIGS. 3 not containing the clear diffuser panels are covered by fiberboard or mental painted black or any suitable color as illustrated in the sections FB 14, FB 14 A, FB 12, FB 16 and FB 16 A. Moreover, the end sections FB 14 A and FB 16 A of the soffit of FIG. 3 can be provided in a plurality of sizes to accommodate side shelf units 14, 16 of varying widths. Also illustrated in FIG. 3 is the spotlight 26 provided for illuminating the advertising artwork depicted as 18 in FIG. 1.

Referring in detail to FIG. 4, there is illustrated a pyramid shaped reflector element generally designated 30 which is adapted for insertion into the central portion of the decorative lanterns 24 of FIG. 1. This pyramid shaped element is covered on the four sides thereof with a plurality of parobolic reflectors 32 which capture the light from overhead fixtures entering through the top of lanterns 24 and reflect the same out through the glass side walls of the lanterns. Thus, these lanterns give the illusion of being electrically powered while they are merely utilizing the ambient light already present in the region of the display rack. Thus, the display rack of the present invention requires no additional electric power to illuminate the products and the decorative lanterns disposed about the periphery of the canopy 20.

It should be understood that the display rack described hereinbefore may be modified as would occur to one of ordinary skill in the art without departing from the spirit and scope of the present invention.

It is claimed:

1. A display rack for displaying packaged beverages, dispensable chilled beverages, and advertising material for said beverages at a common location comprising:

an upstanding frame structure defining a first display section for housing a chilled beverage dispenser and at least one additional display section adjacent said first section for storing and displaying packaged beverages;

advertisng display means depicting the beverage offered for sale in said first section;

a plurality of shelves for supporting said packaged beverages in said at least one additional section;

canopy means disposed over and about the top of said upstanding frame structure for holding said upstanding frame structure together, said canopy means including a canopy frame with an open top and an open bottom to facilitate the transmission of ambient light from above the open top along an optical path through said canopy means and out the open bottom, said canopy means supporting a diffuser means for said ambient light in said optical path, said canopy frame being so shaped as to have substantially no portions in the optical path between said open top said diffuser means, and said open bottom.

2. The display rack of claim 1, wherein said upstanding frame structure defines a central section corresponding to said first section and said at least one additional section comprises one shelf unit on each side of said central section.

3. The display rack of claim 1, wherein said canopy frame is adjustable to vary the size of said open top and bottom, whereby different size display sections may be accomodated therein.

4. The display rack of claim 1, wherein there is further provided a plurality of decorative lanterns secured to said canopy means at spaced locations.

5. The display rack of claim 4, wherein said decorative lantern means have an open top to facilitate the transmission of ambient light from above said open top therethrough and include glass side walls and reflector means therein for directing said ambient light through said glass side walls.

6. The display rack of claim 5, wherein said reflector means comprises a truncated body disposed centrally of said decorative lantern and a plurality of reflector elements mounted about said truncated body.

7. The display rack of claim 1, wherein there is further provided an electrical spotlight in said canopy for illuminating said advertising artwork.

8. The display rack of claim 1, further including holder means on said canopy for displaying a message.

9. A display rack for displaying packaged beverages, dispensable chilled beverages and advertising material for said beverages comprising:

an upstanding frame structure defining a central display section and a pair of side sections on opposite sides of said central section, said central section housing a chilled beverage dispenser;

advertising display means depicting the beverage offered for sale in said central section;

a plurality of shelves for supporting said packaged beverages in each of said side sections;

canopy means disposed over and about the top of said upstanding frame structure for holding said upstanding frame structure together, said canopy means being open at the top to facilitate the transmission of ambient light therethrough and the bottom of said canopy means being provided with means for diffusing said ambient light across the respective sections of said display rack; and decorative lantern means secured to said canopy means at spaced locations thereon, said decorative lantern means being open at the top to facilitate the transmission of ambient light therethrough and including glass side walls and reflector means therein for directing said ambient light through said transparent side walls.

10. The display rack of claim 6 wherein said reflector elements are parabolic reflectors.

11. The display rack of claim 9 wherein said reflector elements are parabolic reflectors.

12. A display rack comprising:

an upstanding frame structure defining a plurality of display sections for storing and displaying articles therein;

a plurality of shelves for supporting said articles in each section; and canopy means disposed over and about the top of said upstanding frame structure for holding said upstanding frame structure together, said canopy means including a canopy frame with an open top and an open bottom to facilitate the transmission of ambient light from above the open top along an optical path through said canopy means and out the open bottom, said canopy means supporting a diffuser means for said ambient light in said optical path, said canopy frame being so shaped as to have substantially no portions in the optical path between said open top said diffuser means, and said open bottom.

13. The display rack of claim 12, wherein there is further provided a plurality of decorative lanterns secured to said canopy means at spaced locations.

14. The display rack of claim 13, wherein said decorative lantern means have an open top to facilitate the transmission of ambient light from above said open top therethrough and include glass side walls and reflector means therein for directing said ambient light through said glass side walls.

15. The display rack of claim 14, wherein said reflector means comprises a truncated body disposed centrally of said decorative lantern and a plurality of reflector elements mounted about said truncated body.

16. The display rack of claim 15, wherein said reflector elements are parabolic reflectors.

17. The display rack of claim 14, wherein said reflector elements are parabolic reflectors.

* * * * *